US008430689B2

(12) United States Patent
Myer et al.

(10) Patent No.: US 8,430,689 B2
(45) Date of Patent: Apr. 30, 2013

(54) ELECTRICAL CONNECTOR

(75) Inventors: John Mark Myer, Millersville, PA (US); Hurley Chester Moll, Hershey, PA (US); James Oliver Crawford, Greesnboro, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/189,234

(22) Filed: Jul. 22, 2011

(65) Prior Publication Data

US 2013/0023153 A1 Jan. 24, 2013

(51) Int. Cl.
*H01R 13/648* (2006.01)

(52) U.S. Cl.
USPC ..... 439/607.01

(58) Field of Classification Search ..... 439/607.01, 439/676, 595, 596
See application file for complete search history.

(56) References Cited

U.S. PATENT DOCUMENTS

| | | | | |
|---|---|---|---|---|
| 4,092,058 | A | 5/1978 | Eigenbrode | |
| 4,602,833 | A * | 7/1986 | Grabbe et al. | 439/292 |
| 4,602,838 | A * | 7/1986 | Davis et al. | 439/354 |
| 4,620,762 | A * | 11/1986 | Davis et al. | 439/350 |
| 4,648,665 | A * | 3/1987 | Davis et al. | 439/108 |
| 4,890,199 | A * | 12/1989 | Beutler | 361/818 |
| 4,979,913 | A | 12/1990 | Aiello et al. | |
| 5,118,310 | A * | 6/1992 | Stroede et al. | 439/676 |
| 5,175,928 | A * | 1/1993 | Grabbe | 29/884 |
| 5,241,453 | A * | 8/1993 | Bright et al. | 361/704 |
| 5,561,267 | A | 10/1996 | Fudoo et al. | |
| 5,647,775 | A | 7/1997 | Polgar et al. | |
| 5,791,943 | A * | 8/1998 | Lo et al. | 439/676 |
| 5,888,096 | A * | 3/1999 | Soes et al. | 439/607.56 |
| 5,919,063 | A * | 7/1999 | Wang | 439/607.01 |
| 6,338,652 | B1 * | 1/2002 | Ko | 439/579 |
| 6,663,427 | B1 * | 12/2003 | Billman et al. | 439/607.07 |
| 6,955,565 | B2 * | 10/2005 | Lloyd et al. | 439/607.01 |
| 7,134,904 | B2 * | 11/2006 | Bergner et al. | 439/410 |

(Continued)

FOREIGN PATENT DOCUMENTS

| | | |
|---|---|---|
| DE | 19727314 A1 | 1/1999 |
| EP | 0778636 A1 | 6/1997 |

(Continued)

OTHER PUBLICATIONS

International Search Report, International Application No, PCT/US2012/047504, International Filing Date, Jul. 20, 2012.

(Continued)

*Primary Examiner* — Amy Cohen Johnson
*Assistant Examiner* — Vladimir Imas

(57) ABSTRACT

An electrical connector has a housing that includes a carrier and a shield matable to define the housing. The carrier has terminal channels and terminal latches extending into the terminal channels. The shield having lead-in channels through a face of the shield. Terminals are received in corresponding terminal channels. The terminals are held in the terminal channels by the terminal latches. The carrier and the shield are molded as a single piece with a bridge connecting the carrier and the shield. The bridge is broken during assembly to allow coupling of the shield to the carrier. The lead-in channels are aligned with, and positioned forward of, the terminal channels when the shield is mated with the carrier. The lead-in channels guide mating contacts for mating with the terminals held in the terminal channels.

20 Claims, 10 Drawing Sheets

U.S. PATENT DOCUMENTS

| | | | | |
|---|---|---|---|---|
| 7,156,672 | B2 * | 1/2007 | Fromm et al. | 439/101 |
| 7,270,570 | B1 * | 9/2007 | Hamner et al. | 439/607.04 |
| 7,762,840 | B2 * | 7/2010 | Hamner et al. | 439/541.5 |
| 7,785,146 | B2 | 8/2010 | Chazottes et al. | |
| 7,857,667 | B1 * | 12/2010 | Wang | 439/676 |
| 8,002,583 | B2 * | 8/2011 | van Woensel | 439/607.56 |
| 8,105,110 | B2 * | 1/2012 | Hsia et al. | 439/607.01 |
| 2002/0028604 | A1 * | 3/2002 | Lo et al. | 439/607 |
| 2003/0228799 | A1 * | 12/2003 | Machado et al. | 439/607 |
| 2003/0232526 | A1 * | 12/2003 | Kappel et al. | 439/92 |
| 2003/0232545 | A1 * | 12/2003 | Kappel et al. | 439/709 |
| 2004/0067680 | A1 * | 4/2004 | Wu | 439/497 |
| 2005/0159040 | A1 * | 7/2005 | Brunker et al. | 439/497 |
| 2006/0084301 | A1 * | 4/2006 | Fromm et al. | 439/101 |
| 2008/0124956 | A1 * | 5/2008 | Wu | 439/80 |

FOREIGN PATENT DOCUMENTS

| | | | |
|---|---|---|---|
| JP | 2005 339850 | A | 12/2005 |
| JP | 2009 123622 | A | 6/2009 |
| WO | 9634429 | A1 | 10/1996 |

OTHER PUBLICATIONS

International Search Report, International Application No. PCT/US2012/056875, International Filing Date, Sep. 24, 2012.

* cited by examiner

ELECTRICAL CONNECTOR

BACKGROUND OF THE INVENTION

The subject matter herein relates generally to electrical connectors holding terminals.

In various applications of electrical connectors, devices are utilized to lock terminals in place and to assure that the terminals are in proper position within the electrical connector. Such electrical connectors are typically used in harsh environments, such as automotive applications, in which the electrical connectors are subject to vibration and other forces that may tend to have the terminals back out of the connectors.

Currently, certain electrical connectors are provided with housings having cavities extending therethrough for receiving terminals. The cavities are provided with resilient locking latches integrally molded with the housing for locking terminals inserted therein. In order to mold the latches and other complicated features into the housing that secure the terminals in the terminal cavities, the electrical connectors are typically manufactured from two housings or shells that are coupled together. Assembly requires picking up both housing pieces, aligning them and mating them together. Such assembly is labor intensive and time consuming. Additionally, both parts are typically molded in separate molds, thereby doubling the manufacturing time for the housing.

A need remains for an electrical connector that includes locking features to secure terminals therein that may be manufactured and assembled in a cost effective and reliable manner.

BRIEF DESCRIPTION OF THE INVENTION

In one embodiment, an electrical connector is provided having a housing that includes a carrier and a shield matable to define the housing. The carrier has terminal channels and terminal latches extending into the terminal channels. The shield has lead-in channels through a face of the shield. Terminals are received in corresponding terminal channels. The terminals are held in the terminal channels by the terminal latches. The carrier and the shield are molded as a single piece with a bridge connecting the carrier and the shield. The bridge is broken during assembly to allow coupling of the shield to the carrier. The lead-in channels are aligned with, and positioned forward of, the terminal channels when the shield is mated with the carrier. The lead-in channels guide mating contacts for mating with the terminals held in the terminal channels.

In another embodiment, an electrical connector is provided having a housing that includes a carrier and a shield matable to define the housing. The carrier has a front, a rear, an inner end, an outer end and opposite sides. The carrier has terminal channels that extend between the front and the rear. The terminal channels are configured to receive corresponding terminals therein. The carrier has terminal latches that extend into the terminal channels. The terminal latches are configured to engage the corresponding terminals to secure the terminals in the terminal channels. The shield has a front, a rear, an inner end, an outer end and opposite sides. The inner end of the shield faces the inner end of the carrier. The shield has lead-in channels through the front of the shield that are configured to receive mating terminals for mating with the terminals held by the carrier. The sides of the shield are connected to the sides of the carrier by a bridge. The bridge is broken during assembly to allow coupling of the shield to the carrier. The lead-in channels are aligned with, and positioned forward of, the terminal channels when the shield is mated with the carrier.

In a further embodiment, an electrical connector is provided having a housing that includes a carrier and a shield separate from the carrier and matable to the carrier to define the housing. The carrier has terminal channels and terminal latches that extend into the terminal channels. The terminal channels are configured to receive corresponding terminals therein. The terminal latches are configured to engage the corresponding terminals to secure the terminals in the terminal channels. The shield has lead-in channels through a front of the shield. The lead-in channels are aligned with, and positioned forward of, the terminal channels when the shield is mated with the carrier. The shield has cradles aligned with, and interior of, the lead-in channels. The cradles are configured to receive mating ends of corresponding terminals to align the terminals with the lead-in channels.

DETAILED DESCRIPTION OF THE INVENTION

Figure 1:
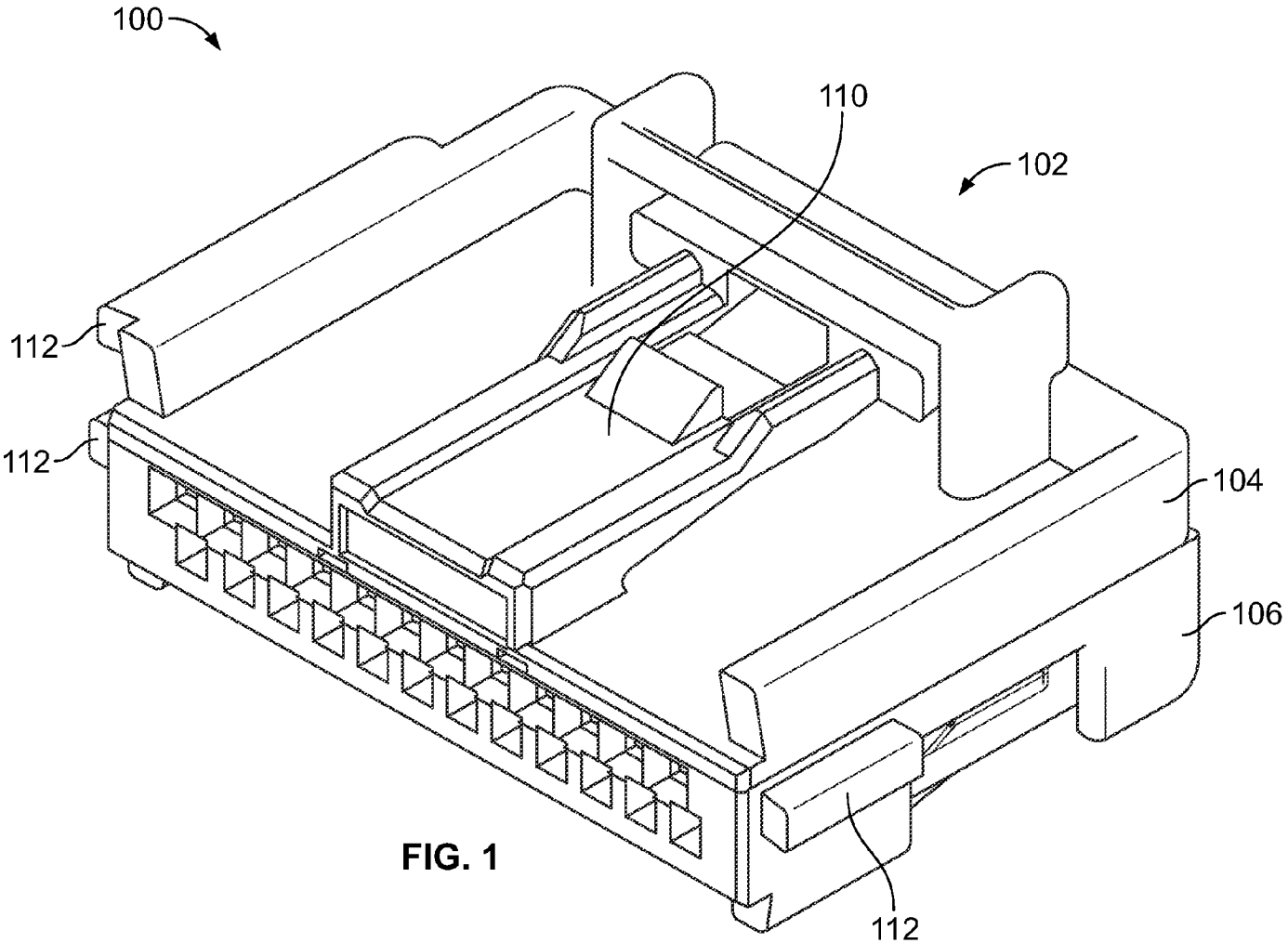
FIG. 1 is a front perspective of an electrical connector formed in accordance with an exemplary embodiment.

FIG. 1 is a front perspective of an electrical connector 100 formed in accordance with an exemplary embodiment. The electrical connector 100 includes a housing 102 having a carrier 104 and a shield 106 matable to the carrier 104 to define the housing 102. The electrical connector 100 may be used in an application, such as in an automotive vehicle system, that involves the interconnection of electrical or fiber optic conductors within the system. The electrical connector 100 represents a robust, low cost, compact design. Furthermore, the configuration and arrangement of the electrical connector 100 enables use of simplified design and manufacturing processes, increasing turnover and lowering cost without adversely impacting quality and reliability.

The carrier 104 is configured to hold a plurality of terminals 108 (shown in FIG. 5) that are configured to be mated with corresponding mating contacts of a mating connector (not shown). The shield 106 surrounds portions of the terminals 108. In an exemplary embodiment, the shield 106 is used to guide the mating terminals into engagement with corresponding terminals 108 during mating of the electrical connector 100 to the mating connector.

A housing latch 110 is used to secure the electrical connector 100 to the mating connector. In the illustrated embodiment, the housing latch 110 extends from the carrier 104. Alternatively, the housing latch 110 may extend from the shield 106.

The housing 102 includes alignment features 112 that are used to align the electrical connector 100 with respect to the mating connector during mating of the electrical connector 100 to the mating connector. Optionally, the alignment features 112 may constitute keying features, wherein the electrical connector 100 may be mated with the mating connector in a single orientation, defined by the alignment features 112. For example, in the illustrated embodiment, one alignment feature 112 is provided on one side of the housing 102 while two alignment features 112 are provided on the opposite side of the housing 102. The alignment features 112 may extend from the carrier 104 and/or the shield 106. The alignment features 112 may be integrally formed with the carrier 104 and/or the shield 106.

Figure 2:
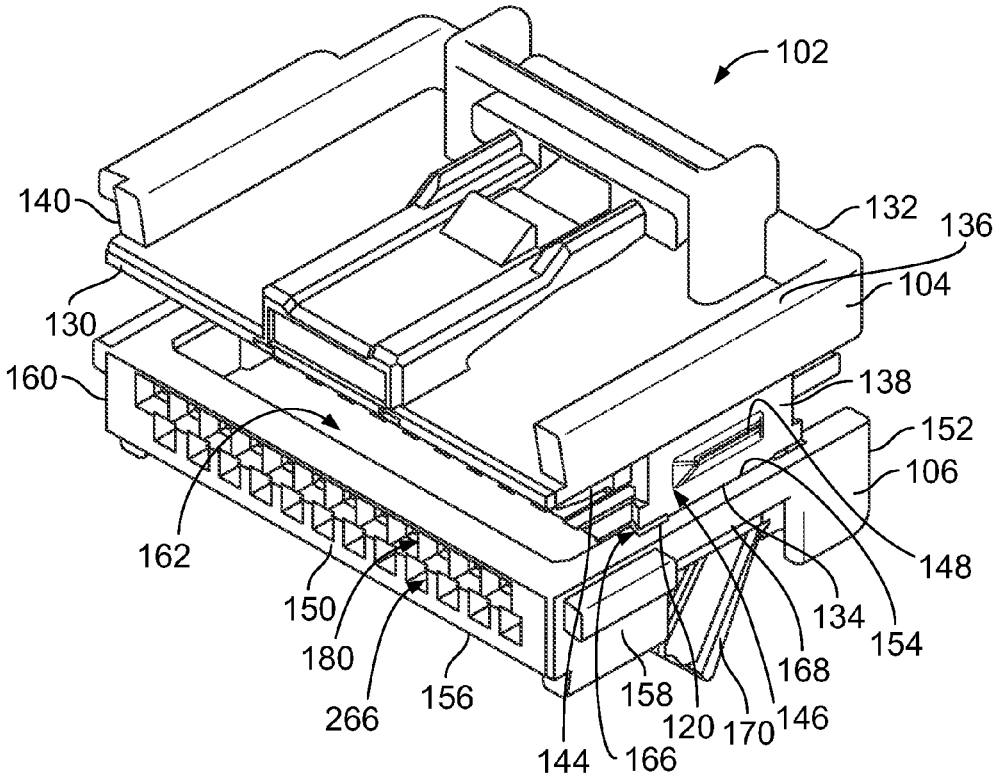
FIG. 2 is a top, front perspective view of a housing of the electrical connector shown in FIG. 1.
Figure 3:
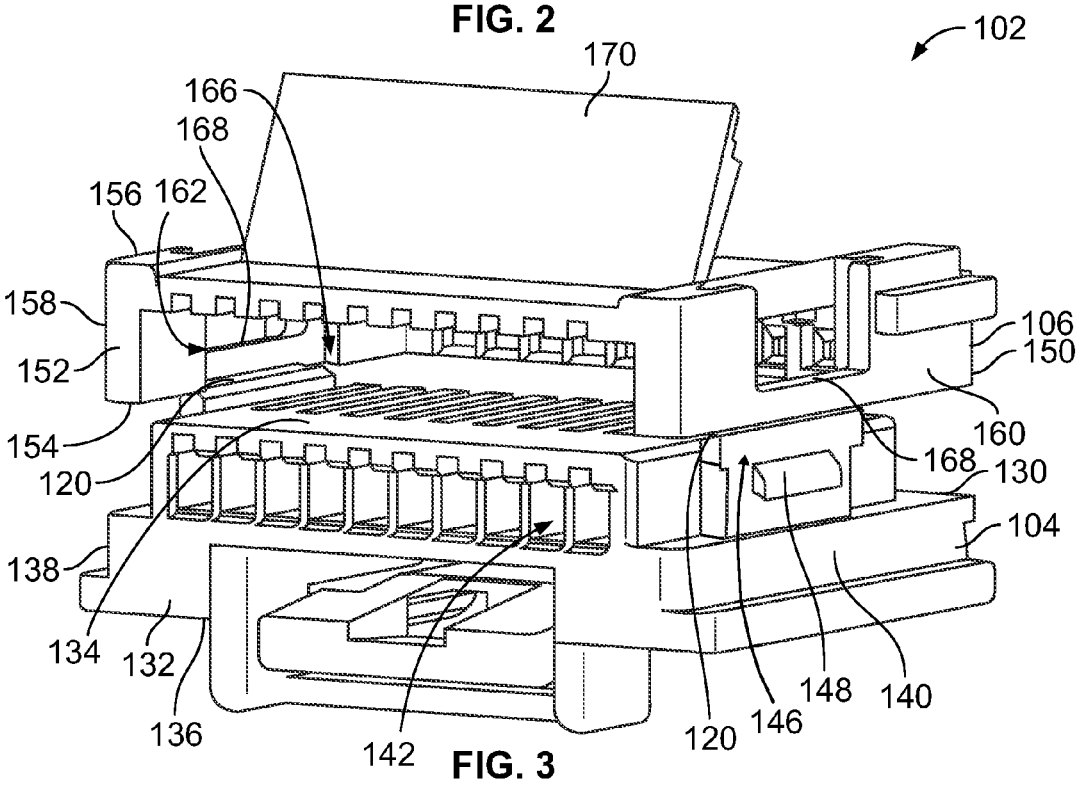
FIG. 3 is a bottom, rear perspective view of a housing of the electrical connector shown in FIG. 1.

FIG. 2 is a top, front perspective view of the housing 102. FIG. 3 is a bottom, rear perspective view of the housing 102. In an exemplary embodiment, when the housing 102 is manufactured, the carrier 104 and the shield 106 are molded as a single piece with a bridge 120 connecting the carrier 104 and the shield 106. The bridge 120 may be flashing that occurs during the molding operation. The bridge 120 may be sized (e.g. have a thickness) and positioned to be breakable to separate the carrier 104 and the shield 106. At some time after molding, the bridge 120 is broken to separate the carrier 104 from the shield 106. For example, in an exemplary embodiment, the housing 102 is manufactured in such a way that the shield 106 is aligned for mating with the carrier 104, whereby the carrier 104 may be pressed straight into the shield 106 in a loading direction, such as in the direction of arrow A.

The bridge 120 is broken during loading of the carrier 104 into the shield 106. The bridge 120 may be broken by applying pressure to the carrier 104 and/or the shield 106. In an alternative embodiment, after manufacture of the housing 102, the carrier 104 and the shield 106 may be separated from one another by breaking the bridge 120 and putting the carrier 104 and the shield 106 in separate bins for assembly at a later time. Having the carrier 104 and the shield 106 co-molded at the same time using the same mold allows a greater volume of housings 102 to be manufactured.

The carrier 104 is manufactured from a dielectric material. The carrier 104 includes a front 130, a rear 132, an inner end 134, an outer end 136 and opposite sides 138, 140. The carrier 104 has a plurality of terminal channels 142 extending between the front 130 and the rear 132. The terminal channels 142 are configured to receive corresponding terminals 108 (shown in FIG. 5) therein. The carrier 104 has terminal latches 144 extending into the terminal channels 142. The terminal latches 144 are configured to engage the corresponding terminals 108 to secure the terminals 108 in the terminal channels 142.

The carrier 104 includes guide features 146 that are used to guide mating of the carrier 104 and the shield 106. In the illustrated embodiment, the guide features 146 are dovetails that are configured to be received within the shield 106. Optionally, the dovetails may be trapezoidal or other shaped features at both ends of the guide features 146. The dovetails may extend for at least a portion of the height of the guide features 146.

The carrier 104 includes securing features 148 that are configured to engage the shield 106 to securely couple the carrier 104 to the shield 106. In an exemplary embodiment, the securing features 148 constitute catches extending outward from the sides 138, 140. In the illustrated embodiment, the securing features 148 extend from the guide features 146. The securing features 148 may be located elsewhere in alternative embodiments.

The shield 106 is manufactured from a dielectric material. The shield 106 includes a front 150, a rear 152, an inner end 154, an outer end 156 and opposite sides 158, 160. The shield 106 has a cavity 162 extending between the front 150 and the rear 152. The cavity 162 is configured to receive the carrier 104 therein.

The shield 106 includes guide features 166 that are used to guide mating of the carrier 104 and the shield 106. The guide features 166 interact with the guide features 146 to guide mating of the carrier 104 and the shield 106. In the illustrated embodiment, the guide features 166 are dovetail channels that receive the guide features 146 of the carrier 104. The dovetail channels may be trapezoidal or other shaped channels. The shape of the dovetail channels complements the shape of the dovetails.

The shield 106 includes securing features 168 that are configured to engage the shield 106 to securely couple the carrier 104 to the shield 106. In an exemplary embodiment, the securing features 168 constitute beams having ledges that engage the catches of the carrier 104 to secure the carrier 104 to the shield 106. A window is provided above the ledges that receives the catches of the carrier 104. The securing features 168 may have other shapes or configurations in alternative embodiments. The securing features 168 may be located elsewhere in alternative embodiments.

The inner ends 134, 154 face one another. During assembly, the inner end 134 of the carrier 104 is pressed into the cavity 162 of the shield 106. Optionally, when manufactured as a single piece, the inner ends 134, 154 are substantially coplanar with one another. The bridge 120 connects the inner ends 134, 154 to one another. For example, during the molding process, the bridge 120 extends between the inner ends 134, 154. The carrier 104 is oriented such that the outer end 136 defines a top of the housing 102. The shield 106 is oriented such that the outer end 156 defines a bottom of the housing 102.

In an exemplary embodiment, the bridge 120 extends between the sides 138, 140 of the carrier 104 and corresponding sides 158, 160, respectively, of the shield 106. For example, the side 138 is connected to the side 158 by the bridge 120 and the side 140 is connected to the side 160 by the bridge 120. The bridge 120 may extend any length. Optionally, the bridge 120 may extend the entire length of the sides 138, 140, 158, 160. In an exemplary embodiment, the bridge 120 extends between the guide features 146 and the guide features 166. The bridge 120 may be elsewhere in alternative embodiments.

The housing 102 includes a secondary lock 170 that is used as a backup locking feature for securing the terminals 108 within the terminal channels 142. In the illustrated embodiment, the secondary lock 170 extends from the shield 106. The secondary latch 170 is integrally formed with the shield 106. The secondary lock 170 is hinged or pivotably coupled to the shield 106. The secondary lock 170 is movable between an opened position and a closed position. In the opened position, the terminals 108 are allowed to be inserted into, and removed from, the terminal channels 142. In the closed position, the secondary lock 170 locks the terminals 108 from being removed from the terminal channels 142. Optionally, the secondary lock 170 may be used as a terminal position assurance device, assuring that the terminals 108 are fully loaded into the terminal channels 142 during assembly. For example, when one of the terminals 108 is not fully loaded, the secondary lock 170 may not be moved to the fully closed position, giving a visual indication that such terminal 108 is not fully loaded into the corresponding terminal channel 142.

Figure 4:
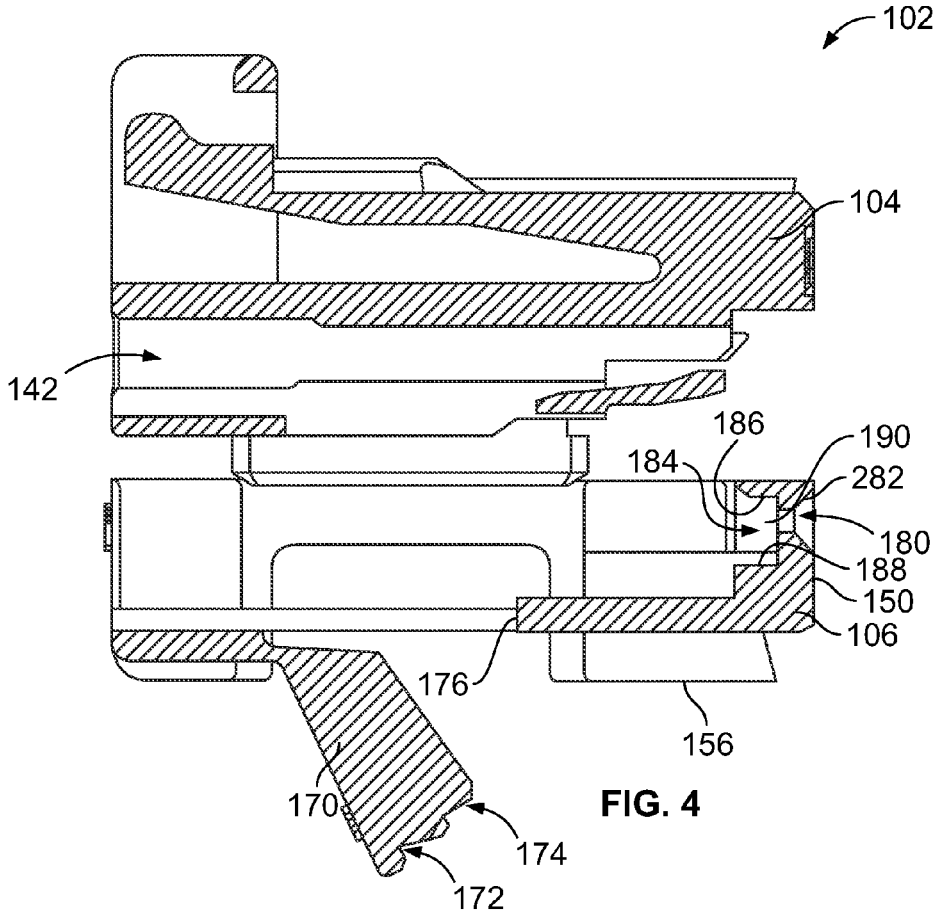
FIG. 4 is a cross-sectional view of the housing shown in FIG. 2.

FIG. 4 is a cross-sectional view of the housing 102. The housing 102 is shown with the carrier 104 and the shield 106 aligned for mating. As described above, the housing 102 may be molded as a single piece with the shield 106 held in an aligned position with respect to the carrier 104 such that the carrier 104 and the shield 106 may be assembled by simply pressing the carrier 104 and the shield 106 together, thereby breaking the bridge 120 (see FIG. 6) between the carrier 104 and the shield 106.

FIG. 4 shows the secondary lock 170 in an open position. The secondary lock 170 has steps 172, 174 at the distal end thereof. The outer end 156 of the shield 106 includes a ledge 176 that supports the distal end of the secondary lock 170. In an exemplary embodiment, the secondary lock 170 is configured to be held by the ledge 176 in multiple positions. For example, when the ledge 176 is received in the step 174, the secondary lock 170 may be held in an intermediate position. When the step 172 engages the ledge 176, the secondary lock 170 is held in a closed position. In the intermediate position, the terminals 108 (shown in FIG. 5) are able to be loaded into corresponding terminal channels 142. In the closed position, the terminal 108 are restricted from being loaded into, or removed from, the terminal channels 142. In an exemplary embodiment, during assembly, the secondary lock 170 is held in the intermediate position, until all of the terminals 108 are loaded into the terminal channels 142. Once all of the terminals 108 are positioned in the terminal channels 142, the secondary lock 170 may be moved to the closed position.

The shield 106 includes lead-in channels 180 at the front 150. The lead-in channels 180 serve to guide the mating contacts into the housing 102. The lead-in channels 180 include chamfered surfaces 182 that guide the mating contacts into the housing 102.

The shield 106 includes cradles 184 aligned with, and interior of, the lead-in channels 180. The cradles 184 are configured to receive the terminals 108. The cradles 184 hold the terminals 108 in position with respect to the lead-in channels 180. The cradles 184 are defined by upper walls 186, lower walls 188, and side walls 190 (only one side wall is illustrated in FIG. 4).

Figure 5:
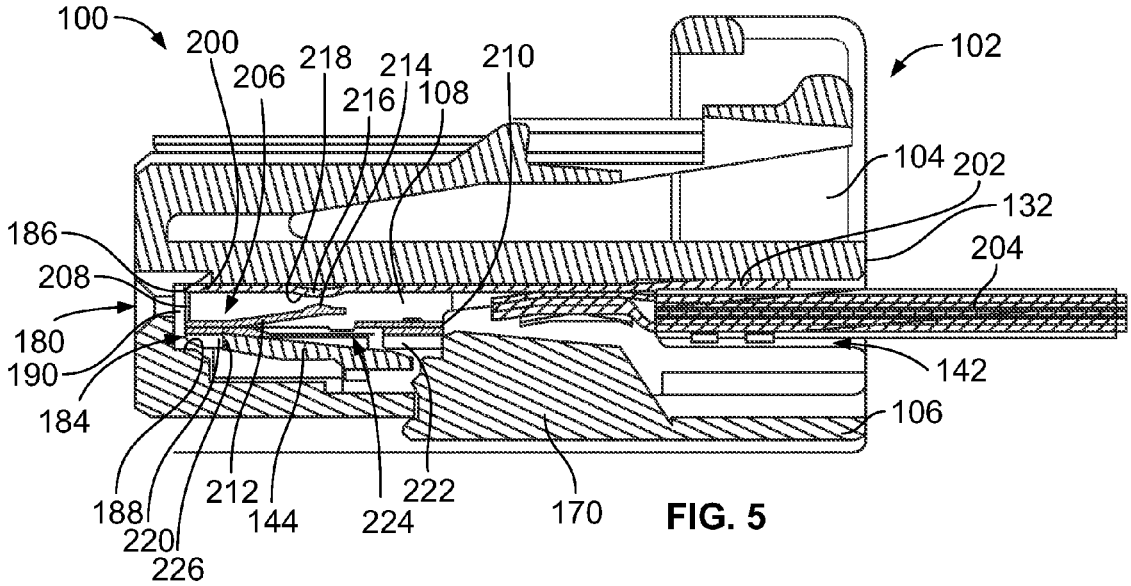
FIG. 5 is a cross-sectional view of the electrical connector showing a terminal loaded into the housing shown in FIG. 2.

FIG. 5 is a cross-sectional view of the electrical connector 100 showing a terminal 108 loaded into the housing 102. During assembly of the housing 102, the carrier 104 and the shield 106 are pressed together.

The terminals 108 include a mating end 200 and a cable terminating end 202. The mating end 200 is configured to be mated to corresponding terminal of a mating connector. The cable terminating end 202 is configured to be terminated to an end of a cable 204. In the illustrated embodiment, the terminal 108 is crimped to the cable 204. The terminal 108 may be terminated to the cable 204 by other means in alternative embodiments, such as by an insulation displacement connection, soldering and the like.

The mating end 200 includes a socket 206 that is configured to receive the mating terminal. The socket 206 extends between a front 208 and a rear 210. Optionally, the socket 206 may be boxed shaped. The socket 206 may be formed by stamping and forming the terminal 108. The terminal 108 includes a spring arm 212 extending into the socket 206. The spring arm 212 includes a mating interface 214 proximate to a distal end of the spring arm 212. Optionally, a bump 216 may be formed in the terminal 108 generally opposite the spring arm 212. The bump 216 includes a mating interface 218 generally aligned with the mating interface 214 and the spring arm 212. The mating terminal is configured to be loaded into the socket 206 to engage the mating interfaces 214, 218 to electrically connect the terminal 108 to the mating terminal.

In an exemplary embodiment, the terminal 108 includes a front extension 220 and a rear extension 222 extending from a bottom of the terminal 108. A terminal latch cavity 224 is defined between the front extension 220 and the rear extension 222. The terminal latch cavity 224 is configured to receive the corresponding terminal latch 144 for securing the terminal 108 in the terminal channel 142. In an alternative embodiment, the terminal 108 may include only a front extension 220, and not the rear extension 222.

The terminal 108 is loaded into the terminal channel 142 through the rear 132 of the carrier 104. The terminal 108 is loaded into the housing 102 until the mating end 200 of the terminal 108 is received in the cradle 184. The mating end 200 engages the upper wall 186, the lower wall 188 and the side walls 190 to limit the amount of float of the terminal 108 within the housing 102. For example, the cradle 184 limits or restricts up and down movement of the terminal 108 as well as side to side movement of the terminal 108. Having the mating end 200 held by the cradle 184, ensures that the opening to the socket 206 is aligned with the lead-in channel 180. Having the position of the mating end 200 controlled by the cradle 184, of the shield 106, ensures that the terminal 108 is aligned by the part (e.g., the shield 106) having the lead-in channels 180. Tolerance concerns due to misalignment or mis-assembly of the shield 106 and the carrier 104 are mitigated because the mating end 200 is controlled by the shield 106 as opposed to the carrier 104, which is the part that holds the terminals 108.

The terminal latch 144 is provided to limit forward and backward motion of the terminal 108 in and out of the terminal channel 142. For example, the terminal latch 144 may be received in the terminal latch cavity 224 behind the front extension 220. A locking surface 226 of the terminal latch 144 engages, and blocks, rearward movement of the terminal 108 out of the terminal channel 142. The terminal latch 144 acts as a primary locking feature for holding the terminal 108 in the terminal channel 142. The secondary lock 170, in the closed position, is positioned behind, and engages, the rear 210 of the terminal 108 to block rearward movement of the terminal 108 out of the terminal channel 142. Optionally, the distal end of the secondary lock 170 may engage the rear extension 222 to block the terminal 108 from moving out of the terminal channel 142.

Figure 6:
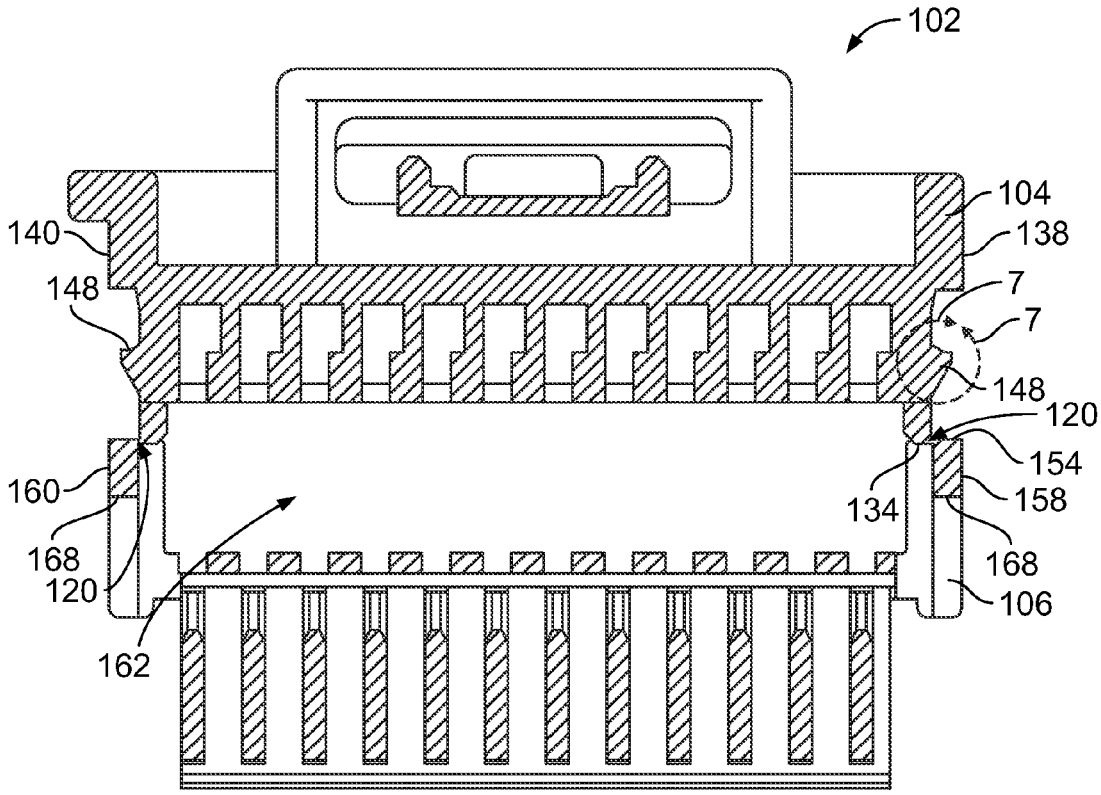
FIG. 6 is a cross-sectional view of the housing shown in FIG. 2 in an unassembled state.

FIG. 6 is a cross-sectional view of the housing 102 in an unassembled state. FIG. 6 shows the carrier 104 and the shield 106 molded as a single piece with the bridge 120 connecting the carrier 104 and the shield 106. The bridge 120 extends between the inner ends 134, 154.

The securing features 148 extend from the sides 138, 140. The securing features 168 are provided at the sides 158, 160. In the illustrated embodiment, the inner portion of the carrier 104 is narrower than the inner portion of the shield 106 such that the inner portion of the carrier 104 may be received in the cavity 162. The sides 158, 160 are configured to be positioned exterior of the sides 138, 140, at least at the inner end 134. One of the securing features 148 is illustrated in greater detail in FIG. 7.

Figure 7:
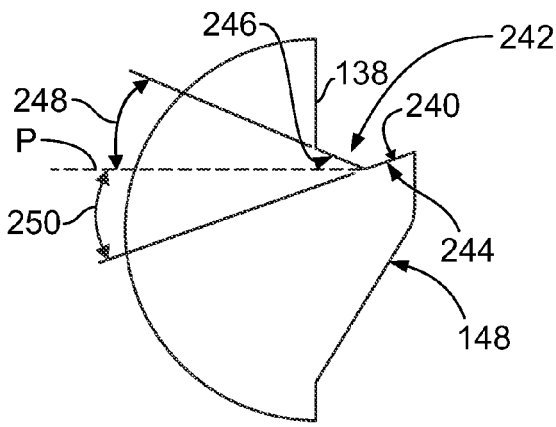
FIG. 7 is an enlarged view of a securing feature of the carrier.

FIG. 7 is an enlarged view of the securing feature 148 of the carrier 104. The securing feature 148 includes a catch 240 that is upward facing. In an exemplary embodiment, the catch 240 extends outward from the side 138. In an exemplary embodiment, the catch 240 has a concave latching surface 242 that is upward facing. The latching surface 242 is defined by an outer latching surface 244 that is distal from the side 138 and an inner latching surface 246 that is interior of the outer latching surface 244. The latching surface 242 is defined by compound angled surfaces with the inner latching surface 246 being angled with respect to the side 138 and with the outer latching surface 244 being angled with respect to the inner latching surface 246. In an exemplary embodiment, the inner latching surface 246 is angled downward, while the outer latching surface 244 is angled upward such that the latching surface 242 has a generally concave shape. The latching surface 242 may include other surfaces that are angled at different angles with respect to the inner and outer latching surfaces 246, 244. In the illustrated embodiment, the inner latching surface 246 is angled at an acute angle 248 with respect to a plane P parallel to the inner and outer ends 134, 136. The outer latching surface 244 is angled at an acute angle 250 with respect to the plane parallel to the inner end 134 and outer end 136.

Figure 8:
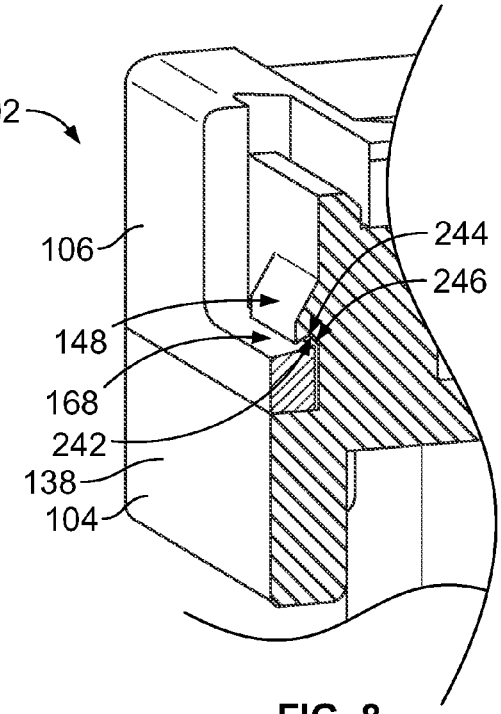
FIG. 8 is a partial sectional view of a portion of the housing showing the carrier coupled to the shield.

FIG. 8 is a partial sectional view of a portion of the housing 102 showing the carrier 104 coupled to the shield 106. The securing feature 148 engages the securing feature 168 to couple the carrier 104 to the shield 106. The securing feature 168 is captured in the area defined between the latching surface 242 and the side 138. In an exemplary embodiment, because the outer latching surface 244 is counter angled with respect to the inner latching surface 246, when the outer latching surface 244 engages the securing feature 168, the carrier 104 is driven further into the shield 106 by the outer latching surface 244. The securing feature 148 holds the carrier 104 against the shield 106. The securing feature 148 takes up any slop between the carrier 104 and the shield 106.

Figure 9:
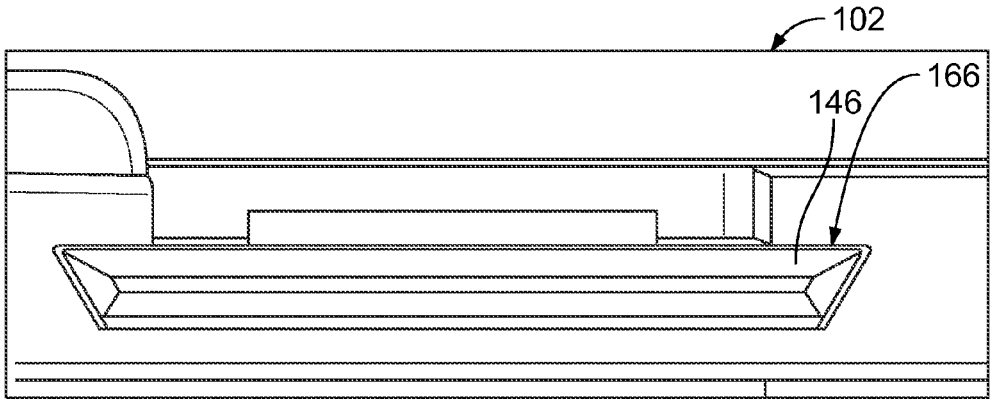
FIG. 9 is a partial sectional view of a portion of the housing shown in FIG. 2.

FIG. 9 is a partial sectional view of a portion of the housing 102. The guide feature 146 and the guide feature 166 are illustrated in FIG. 9. In the illustrated embodiment, the guide feature 146 constitutes a dovetail. The guide feature 166 constitutes a dovetail opening that receives the guide feature 146. The dovetail opening resists the guide feature 146 being pulled out the guide feature 166.

Figure 10:
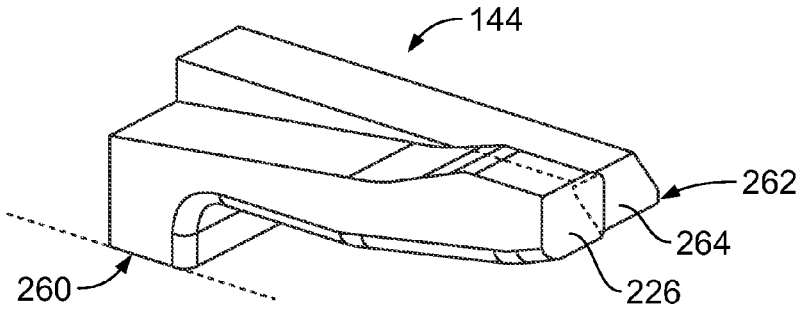
FIG. 10 illustrates a terminal latch formed in accordance with an exemplary embodiment.

FIG. 10 illustrates a terminal latch 144 formed in accordance with an exemplary embodiment. The terminal latch 144 includes a fixed end 260 and a free end 262. The fixed end 260 extends from the body of the carrier 104. The terminal latch 144 may be integrally formed with the carrier 104. The terminal latch 144 is configured to be cantilevered from the carrier 104 and extend to the free end 262. At the free end 262, the terminal latch 144 includes the locking surface 226, which may be oriented substantially vertically. At the free end 262, the terminal latch 144 may include a release surface 264 that is angled with respect to the locking surface 226. The release surface 264 is configured to be engaged by an extraction tool to actuate the terminal latch 144 to release the terminal latch 144 from the terminal 108 (shown in FIG. 5). For example, the extraction tool may be inserted into an extraction window 266 (shown in FIG. 2) adjacent the lead-in channel 180 (shown in FIG. 2). The extraction window 266 provides access to the release surface 264 to extract the terminal latch 144 from the terminal latch cavity 224, thereby releasing the terminal 108 from the terminal cavity 142 (shown in FIG. 3).

Figure 11:
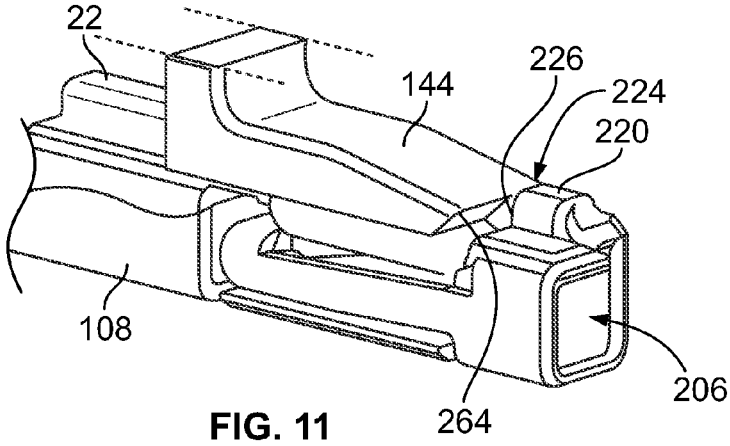
FIG. 11 illustrates a terminal latch in a latched position.

FIG. 11 illustrates the terminal latch 144 in a latched position with respect to a terminal 108. The terminal latch 144 is received in the terminal latch cavity 224 between the front extension 220 and the rear extension 222. The locking surface 226 is positioned immediately behind the front extension 220. In the illustrated embodiment, the front extension 220 extends approximately halfway across the terminal 108 between the opposite sides of the socket 206. As such, clearance is provided to expose the release surface 264 for the extraction tool to pass beyond the front extension 220 to engage the release surface 264 and release the terminal latch 144 from the terminal 108. When released, the terminal latch 144 is deflected or bent away from the terminal 108 until the locking surface 226 clears the front extension 220. Other types of latches may be used in alternative embodiments to hold the terminal 108 in the housing 102 (shown in FIG. 1).

Figure 12:
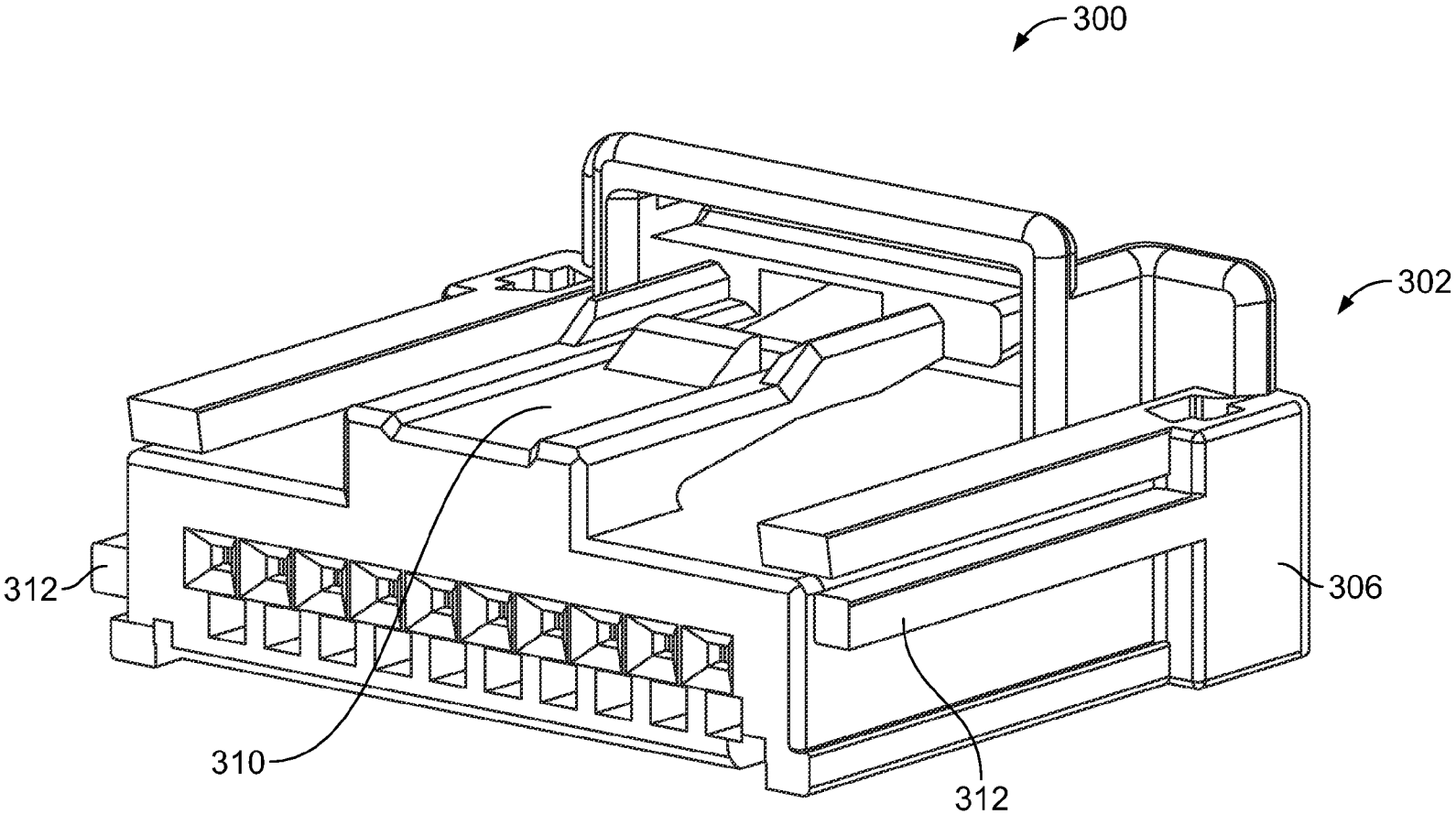
FIG. 12 is a front perspective of an electrical connector formed in accordance with an exemplary embodiment.

FIG. 12 is a front perspective of an electrical connector 300 formed in accordance with an exemplary embodiment. The electrical connector 300 is similar to the electrical connector 100. The electrical connector 300 includes a housing 302 having a carrier 304 (shown in FIG. 13) and a shield 306 matable to the carrier 304 to define the housing 302.

The carrier 304 is configured to hold a plurality of terminals 308 (shown in FIG. 16) that are configured to be mated with corresponding mating contacts of a mating connector (not shown). The terminals 308 may be similar to or identical to the terminals 108 (shown in FIG. 5).

The shield 306 surrounds portions of the terminals 308. In an exemplary embodiment, the shield 306 is used to guide the mating terminals into engagement with corresponding terminals 308 during mating of the electrical connector 300 to the mating connector. A housing latch 310 is used to secure the electrical connector 300 to the mating connector. In the illustrated embodiment, the housing latch 310 extends from the shield 306.

The housing 302 includes alignment features 312 that are used to align the electrical connector 300 with respect to the mating connector during mating of the electrical connector 300 to the mating connector. Optionally, the alignment features 312 may constitute keying features, wherein the electrical connector 300 may be mated with the mating connector in a single orientation, defined by the alignment features 312. For example, in the illustrated embodiment, one alignment feature 312 is provided on one side of the housing 302 near the top and one alignment features 312 is provided on the opposite side of the housing 302 near the bottom.

Figure 13:
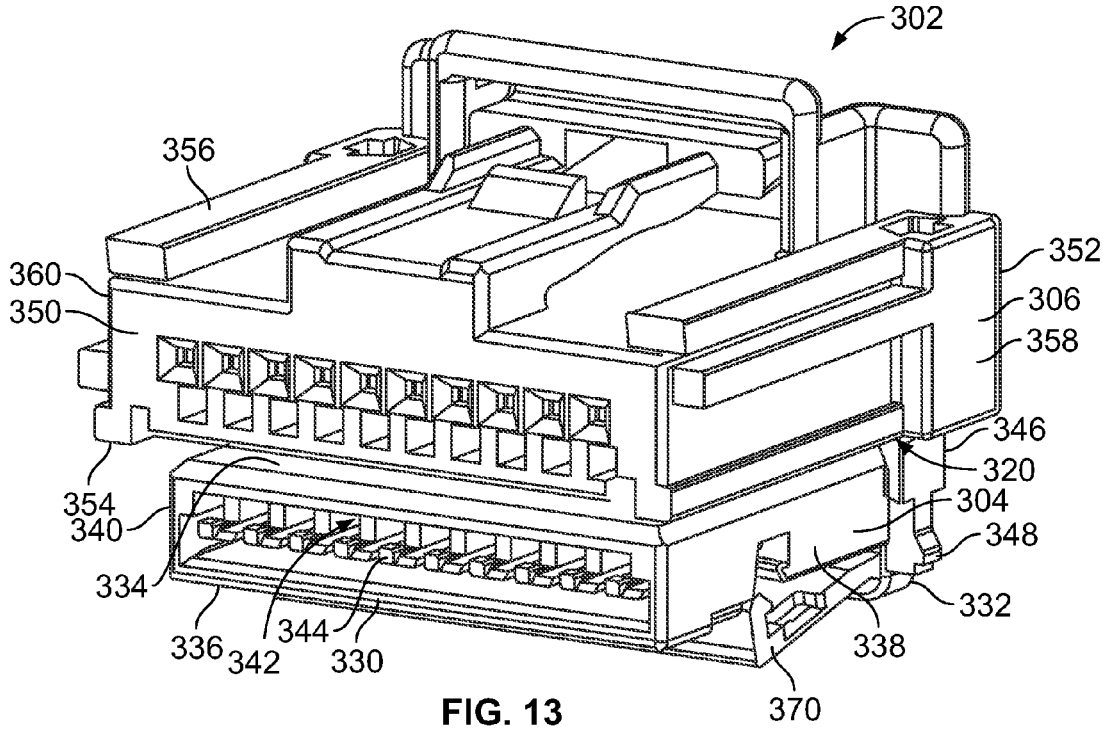
FIG. 13 is a top, front perspective view of a housing for the electrical connector shown in FIG. 12.
Figure 14:
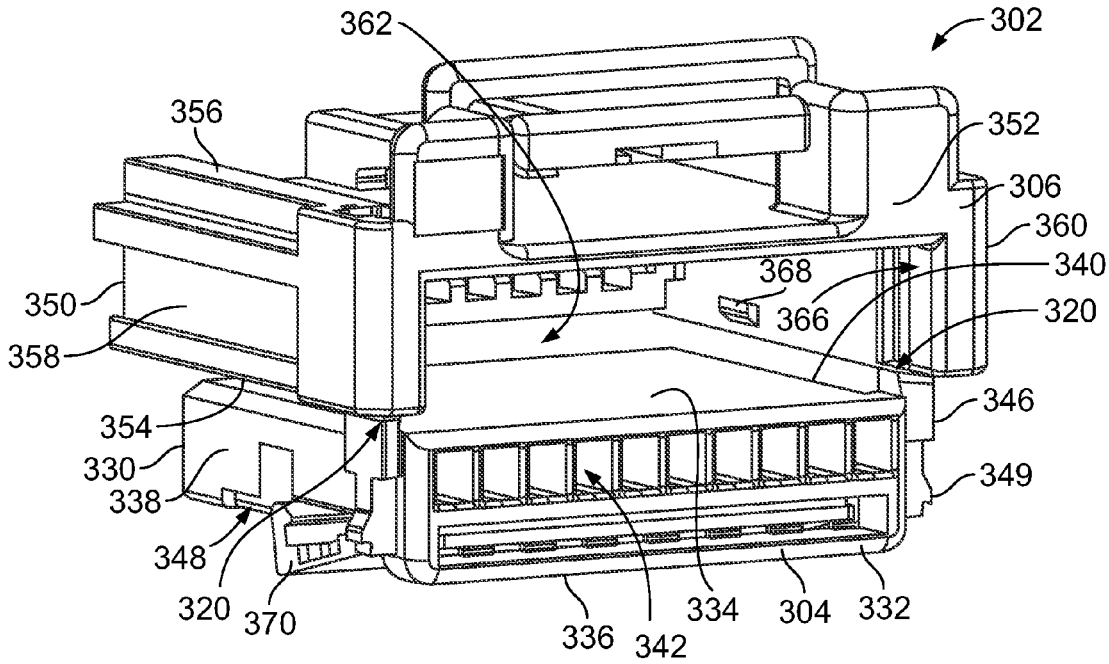
FIG. 14 is a top, rear perspective view of the housing shown in FIG. 13.

FIG. 13 is a top, front perspective view of the housing 302. FIG. 14 is a top, rear perspective view of the housing 302. In an exemplary embodiment, when the housing 302 is manufactured, the carrier 304 and the shield 306 are molded as a single piece with a bridge 320 connecting the carrier 304 and the shield 306. At some time after molding, the bridge 320 is broken to separate the carrier 304 from the shield 306. For example, in an exemplary embodiment, the housing 302 is manufactured in such a way that the shield 306 is aligned for mating with the carrier 304, whereby the carrier 304 may be pressed straight into the shield 306 in a loading direction, such as in the direction of arrow B.

The bridge 320 is broken during loading of the carrier 304 into the shield 306. The bridge 320 may be broken by applying pressure to the carrier 304 and/or the shield 306. In an alternative embodiment, after manufacture of the housing 302, the carrier 304 and the shield 306 may be separated from one another by breaking the bridge 320 and putting the carrier 304 and the shield 306 in separate bins for assembly at a later time. Having the carrier 304 and the shield 306 co-molded at the same time using the same mold allows a greater volume of housings 302 to be manufactured.

The carrier 304 is manufactured from a dielectric material. The carrier 304 includes a front 330, a rear 332, an inner end 334, an outer end 336 and opposite sides 338, 340. The carrier 304 has a plurality of terminal channels 342 extending between the front 330 and the rear 332. The terminal channels 342 are configured to receive corresponding terminals 308 (shown in FIG. 16) therein. The carrier 304 has terminal latches 344 extending into the terminal channels 342. The terminal latches 344 are configured to engage the corresponding terminals 308 to secure the terminals 308 in the terminal channels 342.

The carrier 304 includes guide features 346 that are used to guide mating of the carrier 304 and the shield 306. In the illustrated embodiment, the guide features 346 are dovetails that are configured to be received within the shield 306.

The carrier 304 includes securing features 348, 349 that are configured to engage the shield 306 to securely couple the carrier 304 to the shield 306. In an exemplary embodiment, the securing features 348 constitute pockets in the sides 338, 340. In an exemplary embodiment, the securing features 349 constitute tabs or protrusions extending outward from the carrier 304.

The shield 306 is manufactured from a dielectric material. The shield 306 includes a front 350, a rear 352, an inner end 354, an outer end 356 and opposite sides 358, 360. The shield 306 has a cavity 362 extending between the front 350 and the rear 352. The cavity 362 is configured to receive the carrier 304 therein.

The shield 306 includes guide features 366 that are used to guide mating of the carrier 304 and the shield 306. In the illustrated embodiment, the guide features 366 are dovetail channels that receive the guide features 346 of the carrier 304.

The shield 306 includes securing features 368 that are configured to engage the shield 306 to securely couple the carrier 304 to the shield 306. In an exemplary embodiment, the securing features 368 constitute catches extending into the cavity 362 from the opposite sides thereof. The catches are configured to be received in the pockets of the carrier 304 to secure the carrier 304 to the shield 306.

The inner ends 334, 354 face one another. During assembly, the inner end 334 of the carrier 304 is pressed into the cavity 362 of the shield 306. Optionally, when manufactured as a single piece, the inner ends 334, 354 are substantially coplanar with one another. The bridge 320 connects the inner ends 334, 354 to one another. For example, during the molding process, the bridge 320 extends between the inner ends 334, 354. The carrier 304 is oriented such that the outer end 336 defines a bottom of the housing 302. The shield 306 is oriented such that the outer end 356 defines a top of the housing 302.

In an exemplary embodiment, the bridge 320 extends between the sides 338, 340 of the carrier 304 and corresponding sides 358, 360, respectively, of the shield 306. For example, the side 338 is connected to the side 358 by the bridge 320 and the side 340 is connected to the side 360 by the bridge 320. The bridge 320 may extend any length. Optionally, the bridge 320 may extend the entire length of the sides 338, 340, 358, 360. In an exemplary embodiment, the bridge 320 extends between the guide features 346 and the guide features 366. The bridge 320 may be elsewhere in alternative embodiments.

The housing 302 includes a secondary lock 370 that is used as a backup locking feature for securing the terminals 308 within the terminal channels 342. In the illustrated embodiment, the secondary lock 370 extends from the carrier 304. The secondary lock 370 is integrally formed with the carrier 304. The secondary lock 370 is pivotably coupled to the carrier 304. The secondary lock 370 is movable between an opened position and a closed position. In the opened position, the terminals 308 are allowed to be inserted into, and removed from, the terminal channels 342. In the closed position, the secondary lock 370 locks the terminals 308 from being removed from the terminal channels 342. Optionally, the secondary lock 370 may be used as a terminal position assurance device, assuring that the terminals 308 are fully loaded into the terminal channels 342 during assembly. For example, when one of the terminals 308 is not fully loaded, the secondary lock 370 may not be moved to the fully closed position, giving a visual indication that such terminal 308 is not fully loaded into the corresponding terminal channel 342.

Figure 15:
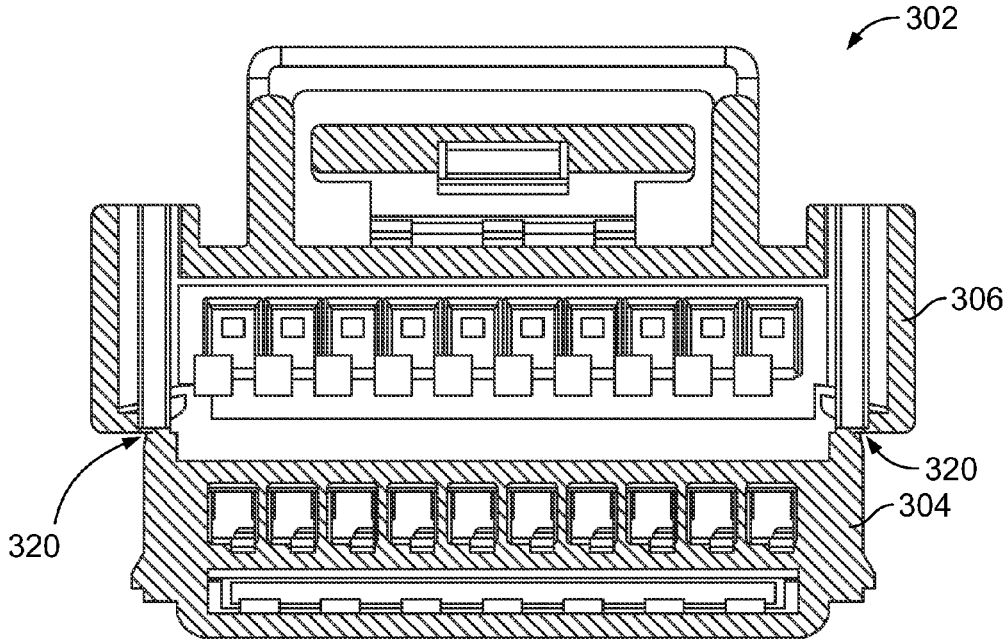
FIG. 15 is a cross-sectional view of the housing shown in FIG. 13.

FIG. 15 is a cross-sectional view of the housing 302. The housing 302 is shown with the carrier 304 and the shield 306 aligned for mating. As described above, the housing 302 may be molded as a single piece with the shield 306 held in an aligned position with respect to the carrier 304 such that the carrier 304 and the shield 306 may be assembled by simply pressing the carrier 304 and the shield 306 together, thereby breaking the bridge 320 between the carrier 304 and the shield 306.

Figure 16:
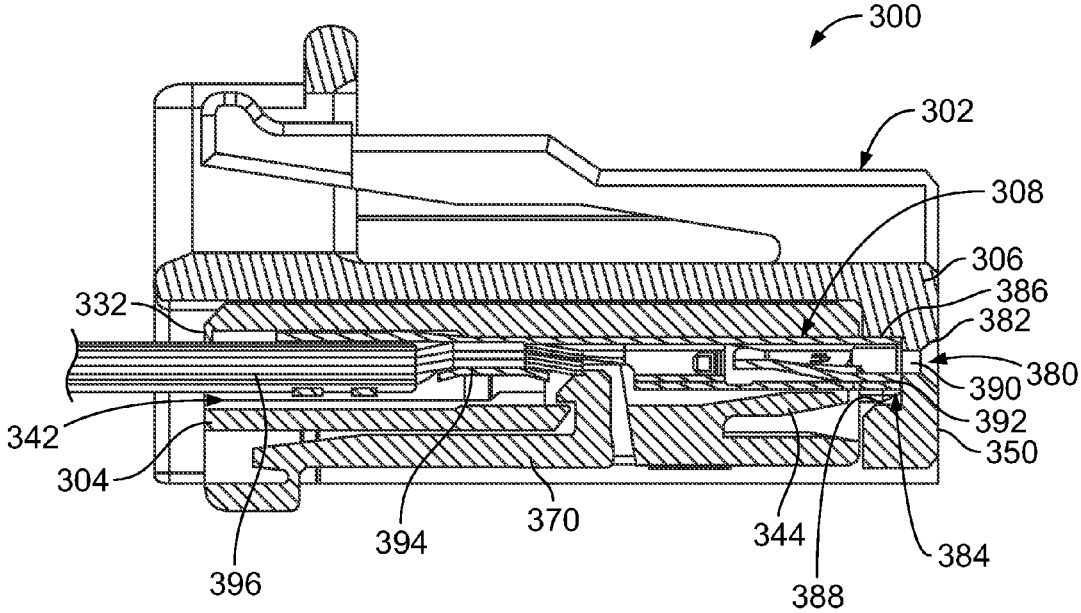
FIG. 16 is a cross-sectional view of the electrical connector shown in FIG. 12.

FIG. 16 is a cross-sectional view of the electrical connector 300 showing a terminal 308 loaded into the housing 302. During assembly of the housing 302, the carrier 304 and the shield 306 are pressed together. FIG. 16 shows the secondary lock 370 in a closed position, locking the terminals 308 in the terminal channels 342.

The shield 306 includes lead-in channels 380 at the front 350. The lead-in channels 380 serve to guide the mating contacts into the housing 302. The lead-in channels 380 include chamfered surfaces 382 that guide the mating contacts into the housing 302.

The shield 306 includes cradles 384 aligned with, and interior of, the lead-in channels 380. The cradles 384 are configured to receive the terminals 308. The cradles 384 hold the terminals 308 in position with respect to the lead-in channels 380. The cradles 384 are defined by upper walls 386, lower walls 388, and side walls 390 (only one side wall is illustrated in FIG. 16).

The terminals 308 include a mating end 392 and a cable terminating end 394. The mating end 392 is configured to be mated to corresponding terminal of a mating connector. The cable terminating end 394 is configured to be terminated to an end of a cable 396. The terminal 308 is loaded into the terminal channel 342 through the rear 332 of the carrier 304. The terminal 308 is loaded into the housing 302 until the mating end 392 of the terminal 308 is received in the cradle 384. The mating end 392 engages the upper wall 386, the lower wall 388 and the side walls 390 to limit the amount of float of the terminal 308 within the housing 302. For example, the cradle 384 limits or restricts up and down movement of the terminal 308 as well as side to side movement of the terminal 308. Having the mating end 392 held by the cradle 384, ensures that the opening to the socket is aligned with the lead-in channel 380. Having the position of the mating end 392 controlled by the cradle 384, of the shield 306, ensures that the terminal 308 is aligned by the part (e.g., the shield 306) having the lead-in channels 380. Tolerance concerns due to misalignment or mis-assembly of the shield 306 and the carrier 304 are mitigated because the mating end 392 is controlled by the shield 306 as opposed to the carrier 304, which is the part that holds the terminals 308.

The terminal latch 344 is provided to limit forward and backward motion of the terminal 308 in and out of the terminal channel 342. The terminal latch 344 acts as a primary locking feature for holding the terminal 308 in the terminal channel 342. The secondary lock 370, in the closed position, is positioned behind, and engages, the rear of the terminal 308 to block rearward movement of the terminal 308 out of the terminal channel 342.

Figure 17:
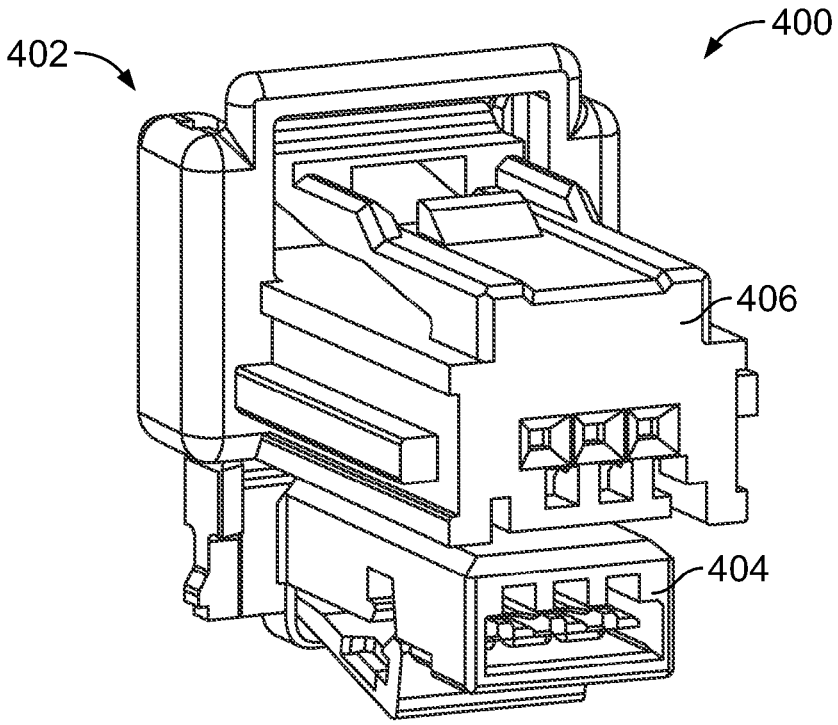
FIG. 17 is a front perspective views of an electrical connector formed in accordance with an exemplary embodiment.
Figure 18:
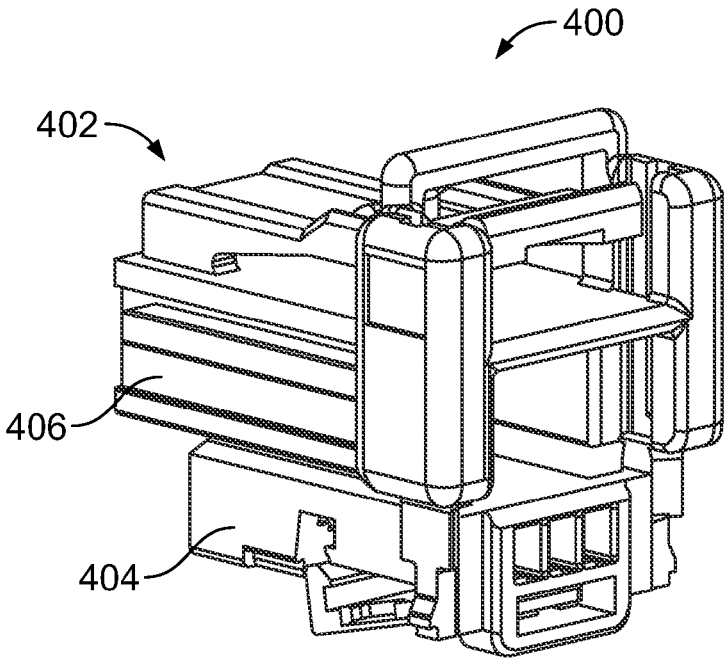
FIG. 18 is a rear perspective view of the electrical connector shown in FIG. 17.

FIGS. 17 and 18 are front and rear perspective views, respectively, of an electrical connector 400 formed in accordance with an exemplary embodiment. The electrical connector 400 is similar to the electrical connectors 100, 300. The electrical connector 400 includes a housing 402 having a carrier 404 and a shield 406 matable to the carrier 404 to define the housing 402. The carrier 404 is connected to the shield 406 by a bridge that is breakable to separate the carrier 404 from the shield 406. The electrical connector differs from the electrical connector 300 in that the electrical connector 400 includes less terminal channels than the electrical connector 300. The electrical connector 400 is manufactured and assembled in a similar manner as the electrical connector 300.

Figure 19:
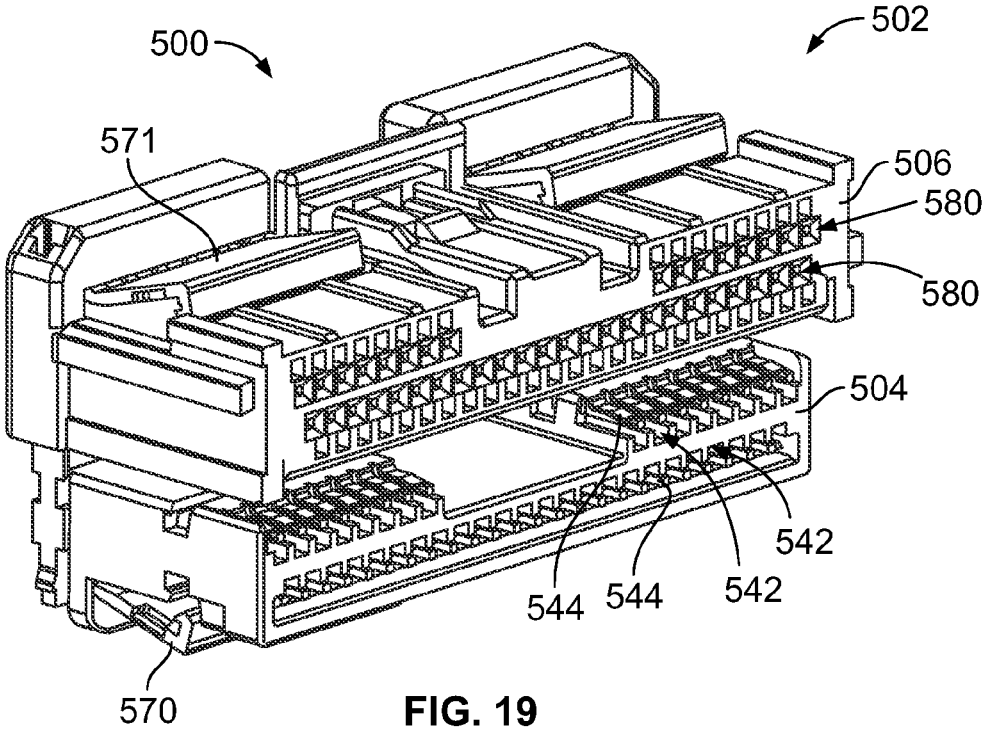
FIG. 19 is a front perspective views of an electrical connector formed in accordance with an exemplary embodiment.
Figure 20:
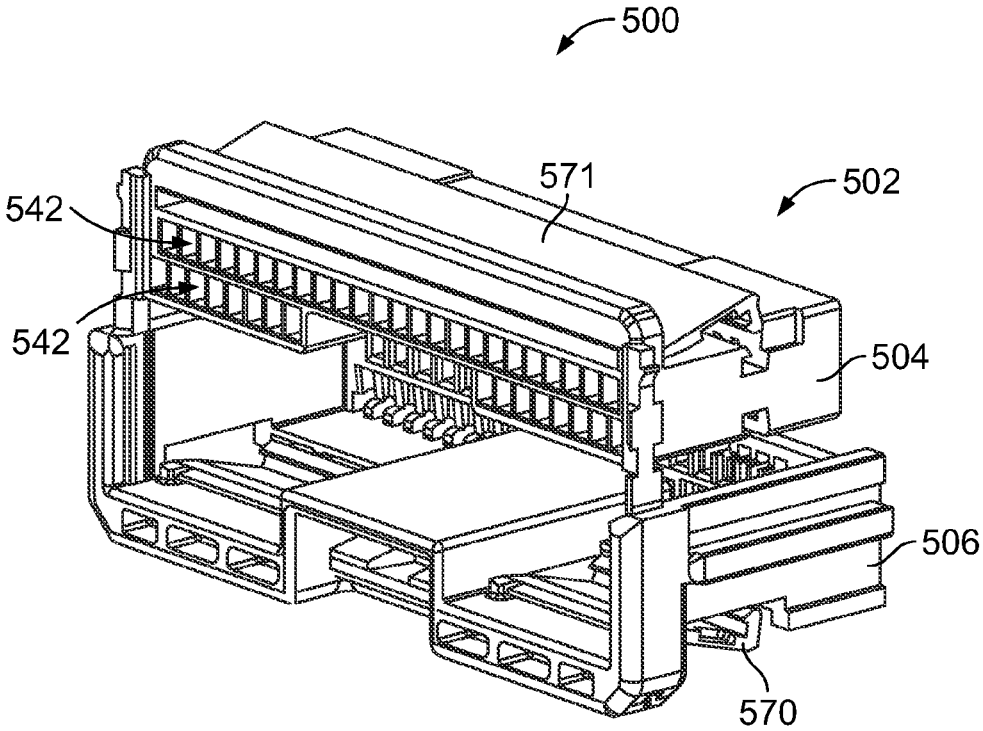
FIG. 20 is a rear perspective view of the electrical connector shown in FIG. 19.

FIGS. 19 and 20 are front and rear perspective views, respectively, of an electrical connector 500 formed in accordance with an exemplary embodiment. The electrical connector 500 includes a housing 502 having a carrier 504 and a shield 506 matable to the carrier 504 to define the housing 502. The electrical connector differs from the electrical connector 300 in that the electrical connector 500 includes more terminal channels 542 than the electrical connector 300. The electrical connector 500 includes two rows of terminal channels 542. The electrical connector includes secondary locks 570 on the carrier 504 and secondary locks 571 on the shield 506. The electrical connector 500 is manufactured in a similar manner as the electrical connector 300, however the carrier 504 includes two rows or sets of terminal latches 544 and the shield 506 includes two rows of lead-in channels 580.

The electrical connector 500 is assembled in a similar manner as the electrical connector 300, with a bridge between the carrier 504 and the shield 506 being broken as the carrier 504 is pressed into the shield 506. The shield 506 is used to guide the mating terminals into engagement with corresponding terminals held by the carrier 504 during mating of the electrical connector 500 to the mating connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing including a carrier and a shield matable to define the housing, the housing having terminal channels configured to receive terminals and terminal latches extending into the terminal channels configured to retain the terminals in the terminal channels, the housing having lead-in channels leading into the terminal channels;

wherein the carrier and the shield are molded as a single piece with a bridge connecting the carrier and the shield, the bridge being configured to be breakable prior to or during assembly to allow coupling of the shield to the carrier.

2. The electrical connector of claim 1, wherein the carrier and the shield are molded with the shield being aligned for mating with the carrier whereby the carrier is configured to be pressed straight into the shield in a loading direction, the bridge being broken during loading of the carrier into the shield.

3. The electrical connector of claim 1, wherein the carrier includes a guide feature, the shield includes a guide feature aligned with, and engaging, the guide feature of the carrier to guide mating of the shield and the carrier, the bridge extending between the guide feature of the shield and the guide feature of the carrier.

4. The electrical connector of claim 1, wherein the carrier includes a front, a rear, an inner end, an outer end, and opposite sides, and wherein the shield includes a front, a rear, an inner end, an outer end, and opposite sides, the inner ends of the carrier and the shield facing one another, the bridge extending between the inner end of the carrier and the inner end of the shield.

5. The electrical connector of claim 1, wherein the carrier includes a front, a rear, an inner end, an outer end, and opposite sides, and wherein the shield includes a front, a rear, an inner end, an outer end, and opposite sides, the outer end of the carrier being oriented to define a top of the housing, the outer end of the shield being oriented to define a bottom of the housing, the bridge extending between the inner ends, the inner end of the carrier being pressed into the shield when the carrier is mated to the shield.

6. The electrical connector of claim 1, wherein the shield includes cradles aligned with, and interior of, the lead-in channels, the cradles being configured to receive mating ends of corresponding terminals to align the terminals with the lead-in channels.

7. The electrical connector of claim 1, wherein the shield includes a front, a rear, an inner end, an outer end, and opposite sides, the shield including cradles aligned with, and interior of, the lead-in channels, the cradles having cradle walls configured to engage the terminals to restrict movement of the terminals toward the outer end, the inner end, and the opposite sides of the shield.

8. The electrical connector of claim 1, wherein the carrier includes a securing feature, the shield includes a securing feature, one of the securing features comprising a ledge, the other of the securing feature comprising a catch engaging the ledge, the catch having a concave latching surface.

9. The electrical connector of claim 1, wherein the carrier includes a securing feature, the shield includes a securing feature, one of the securing features includes a concave latching surface being defined by an outer latching surface distal from the housing and an inner latching surface interior of the outer latching surface, the interior latching surface being angled with respect to the outer latching surface.

10. An electrical connector comprising;

a housing including a carrier and a shield ratable to define the housing;

the carrier having a front, a rear, an inner end, an outer end and opposite sides, the carrier having terminal channels extending between the front and the rear, the terminal channels being configured to receive corresponding terminals therein, the carrier having terminal latches extending into the terminal channels, the terminal latches being configured to engage the corresponding terminals to secure the terminals in the terminal channels;

the shield having a front, a rear, an inner end, an outer end and opposite sides, the inner end of the shield faces the inner end of the carrier, the shield having lead-in channels through the front of the shield that are configured to receive mating terminals for mating with the terminals held by the carrier, the sides of the shield being connected to the sides of the carrier by a bridge;

wherein the bridge is configured to be breakable prior to or during assembly to allow coupling of the shield to the carrier, the lead-in channels being aligned with, and positioned forward of, the terminal channels when the shield is mated with the carrier.

11. The electrical connector of claim 10, wherein the carrier and the shield are molded with the shield being aligned for mating with the carrier whereby the carrier is configured to be pressed straight into the shield in a loading direction, the bridge being broken during loading of the carrier into the shield.

12. The electrical connector of claim 10, wherein the carrier includes a guide feature, the shield includes a guide feature aligned with, and engaging, the guide feature of the carrier to guide mating of the shield and the carrier, the bridge extending between the guide feature of the shield and the guide feature of the carrier.

13. The electrical connector of claim 10, wherein the bridge extends between the inner end of the carrier and the inner end of the shield.

14. The electrical connector of claim 10, wherein the shield includes cradles aligned with, and interior of, the lead-in channels, the cradles being configured to receive mating ends of corresponding terminals to align the terminals with the lead-in channels.

15. The electrical connector of claim 10, wherein the shield includes cradles aligned with, and interior of, the lead-in channels, the cradles having cradle walls being configured to engage corresponding terminals to restrict movement of the terminals toward the outer end, the inner end, and the opposite sides of the shield.

16. An electrical connector comprising:

a housing including a carrier and a shield separate from the carrier and matable to the carrier to define the housing;

the carrier having terminal channels elongated along parallel channel axes and the carrier having deflectable terminal latches extending into the terminal channels, the terminal channels being configured to receive corresponding terminals therein in loading directions along the channel axes, the terminal latches being configured to engage the corresponding terminals to secure the terminals in the terminal channels; and the shield having lead-in channels open through a front of the shield, the front being matable with a mating electrical connector, the lead-in channels being aligned with, and positioned forward of, the terminal channels when the shield is mated with the carrier, the shield having cradles aligned with, and interior of, the lead-in channels, the cradles being positioned forward of the terminal channels, the cradles being configured to receive mating ends of corresponding terminals to align the terminals with the lead-in channels, the lead-in channels guiding mating contacts to corresponding terminals.

17. The electrical connector of claim 16, wherein the shield includes a front, a rear, an inner end, an outer end, and opposite sides, the shield being coupled to the carrier in a loading direction extending through the inner end and the outer end, the cradles having cradle walls being configured to engage the terminals to restrict movement of the terminals toward the outer end, the inner end, and the opposite sides of the shield.

18. The electrical connector of claim 16, wherein the carrier and the shield are molded as a single piece with a bridge connecting the carrier and the shield, the shield being aligned for mating with the carrier whereby the carrier is configured to be pressed straight into the shield in a loading direction, the bridge being configured to be breakable prior to or during assembly of the carrier with the shield.

19. The electrical connector of claim 16, wherein the carrier includes a guide feature, the shield includes a guide feature aligned with, and engaging, the guide feature of the carrier to guide mating of the shield and the carrier, a breakable bridge extending between the guide feature of the shield and the guide feature of the carrier.

20. The electrical connector of claim 16, wherein the carrier includes a front, a rear, an inner end, an outer end, and opposite sides, and wherein the shield includes a front, a rear, an inner end, an outer end, and opposite sides, the inner ends of the carrier and the shield facing one another, a breakable bridge extending between the inner ends of the carrier and the shield.

* * * * *